United States Patent [19]

Jankowski

[11] 4,193,237

[45] Mar. 18, 1980

[54] SKYLIGHT STRUCTURE

[75] Inventor: Dieter K. Jankowski, Glenview, Ill.

[73] Assignee: Imperial Glass Structure, Wheeling, Ill.

[21] Appl. No.: 913,506

[22] Filed: Jun. 7, 1978

[51] Int. Cl.[2] ..... E04B 7/18

[52] U.S. Cl. ..... 52/200; 52/19

[58] Field of Search ..... 52/22, 19, 200

[56] References Cited

U.S. PATENT DOCUMENTS

| | | | |
|---|---|---|---|
| 2,851,973 | 9/1958 | Stark | 52/200 |
| 3,434,250 | 3/1969 | Kiekhaefer | 52/200 |
| 3,440,779 | 4/1969 | Helma | 52/200 |
| 3,791,088 | 2/1974 | Sandow | 52/200 |
| 3,844,087 | 10/1974 | Schultz | 52/200 |

FOREIGN PATENT DOCUMENTS

| | | | |
|---|---|---|---|
| 2336747 | 2/1975 | Fed. Rep. of Germany | 52/200 |

*Primary Examiner*—Price C. Faw, Jr.
*Assistant Examiner*—Henry E. Raduazo
*Attorney, Agent, or Firm*—Michael J. Femal

[57] ABSTRACT

A low profile skylight structure having a curb member and a glazing cap joined together in a framework for supporting an insulated glass panel in which the glazing cap is joined to the curb member by concealed fasteners to avoid any visible fasteners or the like.

4 Claims, 2 Drawing Figures

FIG. 1
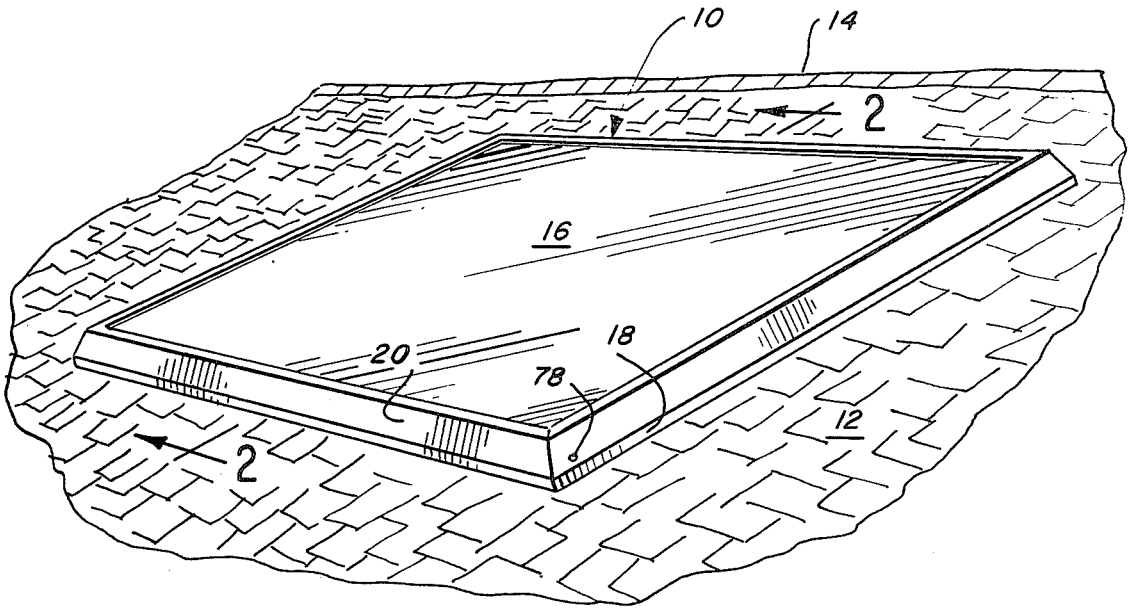
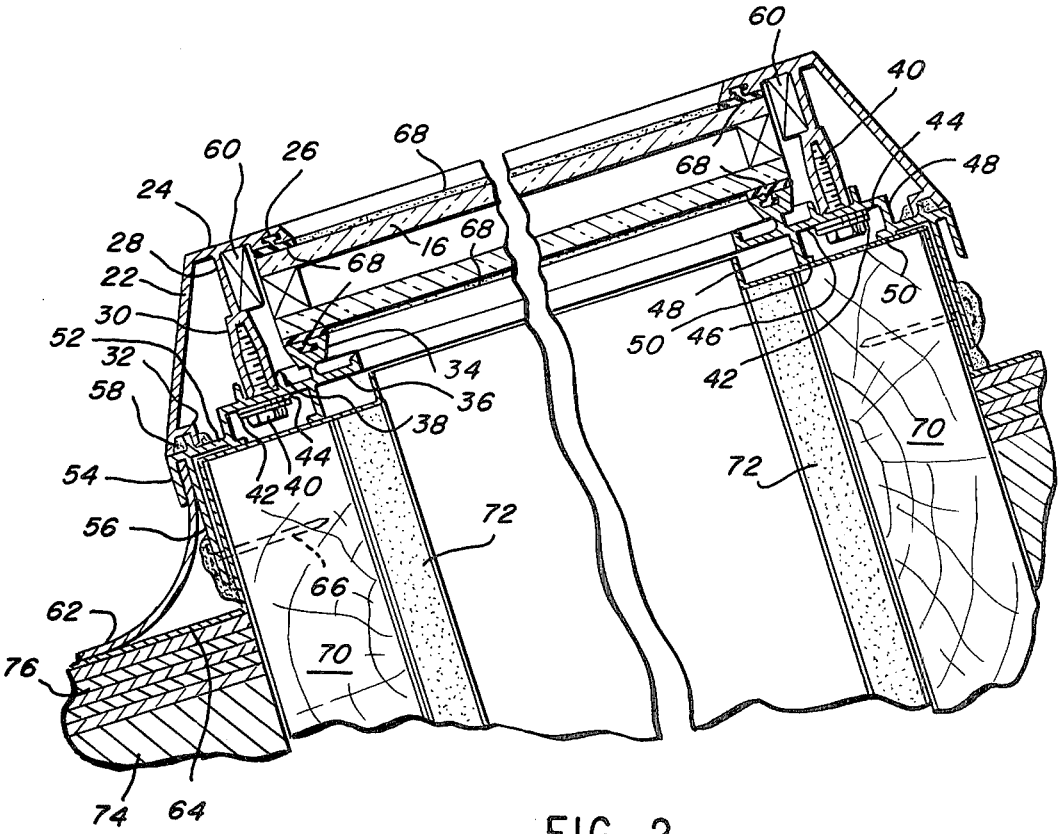
FIG. 2

SKYLIGHT STRUCTURE

BACKGROUND OF THE INVENTION

This invention relates to a skylight and more particularly to a low profile skylight structure joined together in a framework for supporting an insulated glass panel by hidden fasteners to avoid any visible fasteners or the like.

Skylight structures of this general kind usually have exposed fasteners on the sides of the curb framing member or on the top of the glazing cap to join the glazing cap and curb framing member together in a framework. Exposed fasteners detract from the aesthetic appearance of the skylight when viewed by the homeowner or public on the roof of a home. Moreover, unsightly fasteners on the top of the glazing caps not only detract from the overall appearance of the skylight but provide yet another opening which must be sealed against water. In addition, prior art skylights do not provide a low profile and clean design and therefore, they will detract from the roof lines on a home.

Moreover, prior art skylight structures often include bubbled plastic panels or other types of translucent plastic panels in different configurations that detract from the low roof lines on ranch homes and the like.

SUMMARY OF THE INVENTION

With this invention, the foregoing problems are substantially solved. The skylight structure of the present invention offers a wide variety of insulated glass sizes and finishes to provide an imaginative architect, builder or home owner with opportunities for creative skylighting on residential buildings. The skylight structure of the present invention is an assembled square or rectangular skylight with insulating glass, and an extruded aluminum framework including a curb framing member, a glazing cap and an intricate condensate gutter on the curb framing member. The low profile and clean design of the skylight structure prevents detraction from the roof lines of the building. By using insulating glass instead of the standard plastic panel, the advantageous feature of low maintenance is achieved. Insulated glass can also be kept clean without worry of scratching its surface unlike plastic.

Accordingly, a principal object of the present invention is to provide a skylight structure for residential buildings including a low profile and clean design framework which will not detract from the roof lines of a building and in which the framework is held together by concealed fasteners.

Another object of the present invention is to provide a skylight structure for residential buildings which is low maintenance and an energy saver by utilizing an aluminum framework and an insulated glass panel instead of the standard plastic panel.

A skylight structure providing a low profile and low maintenance with framing members joined together by concealed fasteners for aesthetic appearances as well as structural advantages comprises a top framing member or glazing cap joined together with a bottom or curb framing member by concealed fasteners. The bottom framing member which is mounted on a wooden curb frame or the like includes a generally horizontal portion. The horizontal portion includes an elevated bridging section having a pair of legs extending downwardly from a horizontal span terminating in a pair of spaced apart feet resting on top of the flashing on the curb frame. The horizontal span includes an intricate condensate gutter at one end adjacent an upwardly facing glazing groove opposite approximately one of the legs of the bridge span. Approximately intermediate the legs of the bridge and extending upwardly from the bridge span are a pair of walls forming a U-shaped channel on top of the bridge. Extending horizontally outwardly from the other leg of the bridge, closely adjacent to its foot, is another top extension portion of the bottom framing member. Intersecting this horizontal top extension portion and having one end extending slightly thereabove is a vertical skirt extending a predetermined distance down the side of the wooden curb frame. This horizontal extension portion terminates in a depending lip which is parallel to and shorter than the skirt. The top framing member includes a horizontal portion having a glazing strip groove at one end and a depending angled side at the other end forming an obtuse angle with the horizontal portion. Near the bottom edge of the angled side, a right angle projection extends outwardly in the direction of the glazing strip groove and terminates in a vertical leg perpendicular to the horizontal portion, yet terminating on the same horizontal plane as the angled side to form a channel with the angled side. Extending downwardly from the underside of the horizontal portion approximately intermediate the glazing strip groove and the angled side is a wall terminating in a forked shaped channel. When assembling the top and bottom framing members the forked shaped channel fits between the sides of the U-shaped channel on top of the bridge span and the right angle member forming the channel with the angled side receives the upwardly extending one end of the skirt on the bottom framing member. In this assembled position the glazing groove on the top framing member is opposite the glazing groove on the bottom framing member. A self-threading fastener passes between the feet on the bridge and extends through a predrilled hole in the span of the bridge intermediate the sides of the U-shaped channel into engagement with the sides of the forked channel on the top framing member to securely clamp the top framing member to the bottom framing member. This assembly of the top and bottom framing members into a framework for holding an insulated glass panel in a watertight clamped relationship therebetween precludes any unsightly fasteners and the like and forms a framework that provides a low profile and clean design which does not detract from the roof lines of a residential building.

Other objects and advantages will become apparent from the description wherein the references made to the accompanying drawings illustrating the preferred embodiments of the invention, and in which:

FIG. 1 is a perspective view of the skylight structure incorporating the concealed fasteners and low profile in accordance with this invention; and FIG. 2 is a sectional view of the skylight structure taken on the line 2—2 in FIG. 1.

DESCRIPTION OF THE PREFERRED EMBODIMENT

One embodiment of a skylight structure for mounting on residential buildings with concealed fasteners and a low profile framework made according to the invention is illustrated in the drawings.

Referring to FIG. 1 in the drawings, a skylight structure 10 for mounting on residential building or the like having concealed fasteners and a low profile as shown installed on the roof 12 below a ridge 14 in a residential building includes an insulated glass panel 16 held in a watertight relationship between a bottom framing member 18 and a top framing member 20. The framing members 18 and 20 are made out of extruded aluminum and are joined together (to be described in greater detail later) in such a fashion as to eliminate any external fasteners in order to provide the low profile and clean design as shown in FIG. 1 which will not detract from the roof lines of a residential building.

Moreover, the concealed fasteners eliminate the problem of exterior leaks around the fasteners found on other skylight structures.

As shown in FIG. 2 the extruded aluminum framework of the square or rectangular skylight is comprised of the bottom or curb framing member 18 and the upper or angled clamp section 20 supporting an insulated glass panel 16 therebetween. The upper framing member 20 includes an angled side 22 forming an obtuse angle with a horizontal top portion 24. The horizontal top portion 24 includes a downwardly facing glazing groove 26 and a depending wall 28 on the underside thereof terminating in a downwardly facing fork shaped channel 30. A right angle extension 32 extends outwardly from the inner side and near the end of the angled side 22 to form a channel therewith.

The curb or bottom framing member 18 includes an upwardly facing glazing groove 34 adjacent an intricate condensate gutter 36 which extends beyond the glazing groove 34 underneath the insulated glass to collect condensate on the lower surface of the insulated glass panel 16. The glazing groove 34 and condensate gutter 36 are integral with a horizontal bridge span 46 supported by a pair of spaced apart leg walls 48 each terminating in a foot 50. Extending upwardly from the horizontal bridge span 46 is a pair of walls 38 forming a U-shaped channel on top of the bridge span 46. Extending horizontally from the leg wall 48 on the other side of the bridge span from the condensate gutter 36 and near its foot 50 is a top extension 52 terminating in a depending lip 54. Parallel to depending lip 54 and intersecting the top extension 52 is a skirt 56 including a small portion above the top extension 52 and a much larger portion below the top extension 52.

The extruded aluminum framing members are cut to identical lengths of any desirable length to form either a rectangular or square skylight structure. The corners of the framing members are welded together and on the inside corners a silcone sealant is added as a safety precaution. Eight glazing blocks 60, two for each corner are glued on either side of the corner to the depending wall 28 so that the insulated glass panel 16 will not come in contact with the metal of the framing member. Extruded neoprene glazing strips 68 are fit into glazing grooves 26 and 34 on framing members 20 and 18, respectively. A factory assembled insulated glass panel 16 having an upper glass panel of approximately a ¼" and a bottom glass panel of ¼" with an insulation space of ½" therebetween is set on the neoprene glazing strip 68 of the inverted upper framing member 20. Next the bottom framing member is placed in engagement with the upper framing member so that the fork channel 30 of the upper framing member 20 fits between the walls 38 of the U-shaped channel on the lower framing member 18 and the upper end of the skirt 56 extends into the channel defined by the angled side wall 22 and the right angle wall 32. A caulk 58 is placed next to the right angle wall 32 and upper end of skirt 56 to seal the edge between the upper and bottom framing members 18 and 20 from moisture and the like. Next a number 14, 1" hex head self-threading screw 40, with a metal washer 42 and a rubber washer 44 thereon is passed between the leg walls 48 of the bridge span 46 through predrilled holes spaced approximately 9" apart on the bridge span 46 intermediate the walls 38 to self-threadably engage the inside walls of channel 30. By tightening fastener 40, the insulated glass panel 16 is clamped watertight between the neoprene glazing strips 68 in glazing grooves 26 and 34 of the upper framing member 20 and lower framing member 18, respectively.

Thus, with a single type of fastener 40 concealed between the legs 48 of bridge span 46 on the underside of the curb frame member 18, the entire framework of the skylight structure 10 clamps the insulated glass panel 16 therebetween in a watertight relationship without a single exposed fastener while providing an extremely low profile and clean design which will not detract from the roof lines of residential buildings.

Now the skylight structure is ready to be assembled on a residential building. Referring again to FIG. 2, a wooden curb frame 70 with a dry wall 72 frames out the opening on the roof from which it is desired to mount the skylight as described in the present invention. The curb frame 70 is held securely in place against wooden rafters 74 by nails or the like. A wood sheathing such as plywood covers the rafters 74. A metal flashing of aluminum, copper or galvanized metal is placed over the roof sheathing 76 and curb frame 70. The above assembled skylight structure according to the invention is then placed over the flashed opening so that a weep hole 78 as shown in FIG. 1 is at the lower end of the skylight for condensate to drain out of the condensate gutter 36. Next aluminum roofing nails 66 are driven through the lower end of the skirt 56 into the wooden curb frame 70 at a point where there is a notch in the side of the skirt so that the nail can easily penetrate skirt 56. Then a caulking material is placed over the exposed head of the nail 66 and between the lower sides of the skylight and the flashing for a watertight seal. Next the roofing material 62 such as a shingle or the like is slipped into the slot between the lip 54 and skirt 56 to provide a neat and clean finishing of the skylight structure installation.

In summary, the skylight structure of the present invention provides a low profile and clean design for residential buildings in which the fasteners holding the glazing cap and curb framing member together for supporting an insulated glass panel are concealed. This design of the skylight structure eliminates any possibility of moisture seeping through around any exposed fasteners on the outside of the framing members. The extruded aluminum framing members as well as the insulated glass instead of the standard plastic panel assure low maintenace. The intricate gutter design provides a means for expelling condensate through a single weep hole on the lower end of the skylight structure.

I claim:

1. In a skylight structure for mounting on a flashed curb frame on residential buildings or the like having a single translucent glazing panel and a framework supporting said panel, the improvement comprising:

a top framing member of said framework having a horizontal wall with a downwardly facing glazing groove at one end and a depending wall at the other end, said top framing member further including a wall depending from the underside of said horizontal wall terminating in a fork shaped channel; and a bottom framing member of said framework having a generally horizontal portion including an elevated bridge section having a pair of leg walls extending downwardly from the horizontal span of the bridge and terminating in a pair of spaced apart feet for mounting on top of the flashed curb frame, an upwardly facing glazing groove at one end of the bridge span, and a pair of walls extending upwardly intermediate the bridge span defining a U-shaped channel on top of the bridge span for receiving the forked shape channel of the top framing member therebetween, said bridge span having predrilled holes intermediate the channel walls and spaced apart at predetermined intervals so that a self-threading fastener can be passed between the feet and legs of the bridge span on the bottom framing member and extended through the predrilled hole into engagement with the inside walls of the fork shaped channel so that by tightening the fastener, the top framing member is pulled into tighter engagement with the bottom framing member clamping the translucent panel between glazing strips in the glazing grooves of the top and bottom framing members in a watertight relationship without a single exposed fastener holding the framework together.

2. The skylight structure of claim 1, wherein said top and bottom framing members including their walls and other portions are each an integral, extruded aluminum piece.

3. The skylight structure of claim 1 wherein said bottom framing member further includes a vertical skirt intersecting said horizontal portion at approximately one end thereof, said skirt extending a short distance above said horizontal portion and a greater distance below said horizontal portion, said depending wall at the other end of the top framing member further includes a right angle leg wall extending from the inside thereof and forming a channel with the end of said depending wall for receiving said portion of the skirt extending above the horizontal portion to add structural stability to said assembled framework.

4. The skylight structure of claim 1, wherein said bottom framing member further includes an intricate condensate gutter adjacent said glazing groove and on the other side of the glazing groove than the U-shaped channel, said gutter extending partially underneath of said translucent panel to collect condensate, said depending wall at the other end of the horizontal wall portion of the top framing member having a weep hole for expelling said collected condensate.

* * * * *